United States Patent [19]

Kaeser

[11] 4,311,606

[45] * Jan. 19, 1982

[54] METHOD FOR MANUFACTURE OF NON-GELLING, STABLE INORGANIC SALT CRUTCHER SLURRIES

[75] Inventor: James A. Kaeser, Somerset, N.J.

[73] Assignee: Colgate Palmolive Company, New York, N.Y.

[ * ] Notice: The portion of the term of this patent subsequent to Oct. 13, 1998, has been disclaimed.

[21] Appl. No.: 199,601

[22] Filed: Oct. 21, 1980

Related U.S. Application Data

[63] Continuation-in-part of Ser. No. 128,574, Mar. 10, 1980.

[51] Int. Cl.[3] ..... C11D 3/08; C11D 3/10; C11D 3/20; C11D 11/02

[52] U.S. Cl. ..... 252/135; 252/91; 252/174; 252/174.13; 252/174.14; 252/174.19; 252/174.21

[58] Field of Search ..... 252/91, 140, 174, 174.13, 252/174.14, 174.21, 135, 174.19

[56] References Cited

U.S. PATENT DOCUMENTS

| | | | |
|---|---|---|---|
| 3,594,323 | 7/1971 | Taylor | 252/526 |
| 3,869,399 | 3/1975 | Collins | 252/118 |
| 3,886,098 | 5/1975 | Di Salvo | 252/540 |
| 3,893,955 | 7/1975 | Hewitt | 252/551 |
| 4,075,117 | 2/1978 | Morton | 252/135 |

FOREIGN PATENT DOCUMENTS

| | | | |
|---|---|---|---|
| 2003913 | 3/1979 | United Kingdom | 252/135 |

*Primary Examiner*—Dennis L. Albrecht

[57] ABSTRACT

Gelation and setting of desirably miscible and pumpable aqueous crutcher slurries comprising sodium bicarbonate, sodium silicate and sodium carbonate are retarded and often are prevented by the addition of sodium sesquicarbonate (which serves as a source of sodium carbonate and sodium bicarbonate) after admixing of sodium bicarbonate, sodium carbonate (if added earlier) and sodium silicate. Desirably, citric acid is dissolved in the crutcher medium before addition of the sodium sesquicarbonate but its presence is not necessary. The method of the invention appreciably increases workable crutcher time (stabilizes the mix against gelation) compared to prior methods of manufacturing similar crutcher mixes of similar contents of bicarbonate and carbonate (considering the sesquicarbonate of the present method as a source of carbonate and bicarbonate), whether all the carbonate and bicarbonate are separately added to the crutcher before the silicate or are added partially before and partially after silicate addition. The improved workability and stability of the crutcher mix permit the making of higher solids content crutcher slurries, thereby resulting in significant energy savings and increases in production rates when such slurries are subsequently spray dried to produce free flowing inorganic salt base beads, from which beads built or heavy duty detergent compositions may be made by post-spraying onto the base beads a nonionic synthetic organic detergent in liquid state.

16 Claims, No Drawings

METHOD FOR MANUFACTURE OF NON-GELLING, STABLE INORGANIC SALT CRUTCHER SLURRIES

This application is a continuation-in-part of my copending application Ser. No. 128,574, filed Mar. 10, 1980.

This invention relates to a method for the manufacture of non-gelling, stable inorganic salt crutcher slurries which are useful for the manufacture of built detergent compositions. More particularly, it relates to the manufacture of such slurries in which sodium sesquicarbonate is incorporated (and serves as the source of sodium carbonate and sodium bicarbonate) by admixing it with other components of final relatively high solids content aqueous inorganic salt slurries including sodium bicarbonate and sodium silicate, whereby such slurries are stablized and gelation, excess thickening and setting thereof are prevented.

As was mentioned in my application Ser. No. 128,574, the disclosure of which is incorporated herein by reference, some household laundry detergent compositions are now made by spray drying inorganic builder salt mixtures, devoid of organic detergent, and subsequently spraying onto the surfaces of the resulting spray dried beads a nonionic detergent in liquid state, so that it is absorbed by the beads. Among the more satisfactory products made by this method are those produced by the absorbing into such bead interiors of a nonionic detergent, such as a condensation product of a poly-lower alkylene oxide and a lipophilic material, e.g., higher fatty alcohol, with spray dried beads that are comprised of alkali metal bicarbonate, alkali metal carbonate and alkali metal silicate. However, it has been found that aqueous crutcher slurries or crutcher mixes containing substantial proportions of bicarbonate, carbonate and silicate tend to gel or set prematurely, sometimes before they can be thoroughly mixed and pumped out of a crutcher to spray towers, and consequently, extensive experimentation has been undertaken in an effort to find ways to diminish tendencies of such systems to solidify or gel in the crutcher. For aqueous crutcher slurries containing sodium carbonate, sodium bicarbonate, and sodium silicate, with the carbonate and bicarbonate being added as anhydrous powders and the silicate being added as an aqueous solution, setting of the slurry or mix occurs most readily when the carbonate content (which may be about the same as the silicate solids content, e.g., often about 5 to 25%, preferably 12 to 17%, on a solids basis) is more than about 20 or 21% of the bicarbonate content.

Prior to the present invention it had been discovered by a fellow researcher that small quantities of citric acid or water soluble citrate incorporated in a crutcher mix could delay or prevent gelation or setting of bicarbonate-carbonate-silicate mixes and would allow commercial spray drying thereof, following normal procedures for pumping out of the crutcher contents to the spray nozzles. Such invention is described in U.S. patent application Ser. No. 81,799, filed Oct. 4, 1979 by Ronald S. Schreiber. An improvement over that invention was subsequently discovered by the present inventor, and is described in Ser. No. 128,574. Essentially, such discovery is that the anti-gelling effect of the citric material is greatly increased when magnesium sulfate is also present. A further advantage of such invention is that the proportion of organic material (the citric material) in the inorganic salt product being made can be decreased. Now, as a result of the present invention, it is not necessary (although it may sometimes be additionally desirable) to utilize the magnesium sulfate additive, lesser amounts of citric acid may be employed (and often it may be eliminated entirely) and the anti-gelling material (sodium sesquicarbonate), utilized at a particular step in the making of the crutcher mix, is a source of active builders for the final detergent product.

In accordance with the present invention a method of retarding or preventing the gelation of a crutcher slurry containing from about 40 to 70% of solids and 60 to 30% of water, of which solids content, on a 100% solids basis, about 55 to 85% is sodium bicarbonate, about 5 to 25% is sodium carbonate and about 2 to 25% is sodium silicate of $Na_2O:SiO_2$ ratio within the range of 1:1.4 to 1:3, with the ratio of sodium bicarbonate:sodium carbonate being within the range of about 2:1 to 8:1, the ratio of sodium carbonate:sodium silicate being with the range of about 1:3 to 3:1, and the ratio of sodium bicarbonate:sodium silicate being within the range of about 2:1 to 10:1, comprises the preparation of a crutcher slurry of the described composition by admixing with other components of such slurry portions of the sodium carbonate and the sodium bicarbonate as sodium sesquicarbonate. In preferred embodiments of the invention some citric material will be present in the crutcher, the order of addition of components will be specified, the crutcher, medium and slurry will be at an elevated temperature, mixing will continue for at least an hour or two without gelation in the crutcher, and the crutcher slurry will be spray dried to free flowing inorganic base beads, which are capable of absorbing nonionic detergent when it is in liquid form, to make finished built detergent compositions.

Without admitting that for the purpose of the Patent Law it is applicable prior art, it is recognized by the present inventor that prior to his invention the most preferred way of retarding gelation of aqueous bicarbonate-carbonate-silicate crutcher slurries were those described in his and Ronald S. Schreiber's U.S. patent applications Ser. Nos. 81,799 and 128,574. Prior to Schreiber's work sodium citrate had been a known water softening or organic builder constituent of synthetic organic detergent compositions. Also, it had been suggested that magnesium salts could be added to synthetic detergent compositions or to wash waters containing them so as to increase foaming of anionic synthetic organic detergents in such media. The problem of soluble silicates forming insoluble products in detergent compositions and in wash water had been recognized and efforts have been made to prevent objectionable deposits of silicates on laundered articles. Particular polyvalent metals have been suggested for "capping" alkali metal silicates to reduce polymerization thereof. For example, see U.S. Pat. No. 4,157,978. Also, sodium sesquicarbonate had been recognized as a useful builder in detergent compositions and its formula, $Na_2CO_3.NaHCO_3.2H_2O$, indicates to those of skill in the art that it may act as a source of sodium carbonate and sodium bicarbonate. However, the prior art does not suggest the exceptionally good and unexpectedly beneficial anti-gelling and stabilizing effect of the utilization of sodium sesquicarbonate and its addition to crutcher slurries of the present type after additions of the bicarbonate, silicate and any carbonate that may be included. Furthermore, the prior art does not suggest the stabilizing effect of the late addition of sodium sesquicarbonate to such crutcher mixes containing small anti-gelling proportions of citric material, or of citric material plus magnesium sulfate.

Although the anti-gelling features of the present invention may also be obtained with other inorganic builder base composition slurries than those of this invention, which are primarily of sodium bicarbonate, sodium carbonate, sodium silicate and water, the most significant anti-gelling and stabilizing effects are noted when crutcher slurries based substantially (preferably essentially) on such sodium salts and water are treated by the method of this invention, i.e., addition of sodium sesquicarbonate, in the form of its dihydrate, to such a slurry after the making of the slurry has been completed except for the addition of sesquicarbonate, and when the slurry is in mobile and pumpable form. Often, the crutcher slurry is prevented from gelling before the addition of the stabilizing and anti-gelling sodium sesquicarbonate by the presence of a citric material, such as citric acid, in some cases with magnesium sulfate also being present, or with magnesium citrate being used instead of the citric acid-magnesium sulfate combination. The compositions treated by the method of the present invention comprise about 40 to about 70% of solids and are about 60 to about 30% of water. The solids contents, on a 100% solids basis, are about 55 to about 85% of sodium bicarbonate, about 5 to about 25% of sodium carbonate and about 5 to about 25% of sodium silicate, with the sodium silicate being of $Na_2O$:-$SiO_2$ ratio within the range of 1:1.4 to 1:3. In such compositions the ratio of sodium bicarbonate:sodium carbonate is within the range of about 2:1 to about 8:1, the ratio of sodium carbonate:sodium silicate is within the range of about 1:3 to about 3:1 and the ratio of sodium bicarbonate:sodium silicate is within the range of about 2:1 to about 10:1. Because the sodium sesquicarbonate added at the end of the making of the crutcher slurry may be considered to be comprised of sodium carbonate and sodium bicarbonate, the proportions thereof present, about 47% and about 37%, respectively, should be calculated in the crutcher slurry formula as being parts of the solids content thereof and parts of the carbonate and bicarbonate components thereof. Also, the hydrating water present with the sesquicarbonate, about 16% thereof, is counted as being part of the solids content of the crutcher mix because for the most part it is considered that a significant proportion of the sesquicarbonate remains undissolved in the crutcher slurry.

It has been theorized by the present inventor that the generation of sodium sesquicarbonate in the crutcher, when crutcher slurries are made with soda ash, sodium bicarbonate powder and sodium silicate solution, in an aqueous medium, may be contributory to undesirable thickening, gelation and freezing of such slurries. On this basis, his addition of sodium sesquicarbonate, which is in finely divided form (all the materials added as solids to form the slurry are in similar finely divided form) may be helping to "seed" the medium and thereby produce additional sesquicarbonate crystals of smaller particle sizes than would otherwise result. Thus, the slurry viscosity would be stabilized and freezing or setting in the crutcher would be avoided. Although this theory seems to be valid, and explains the results obtained, applicant is not bound by it and patentability of his invention does not depend on it. In this specification when sodium sesquicarbonate is referred to, as it was above, it is meant to denote the dihydrate type product, which is available as naturally occurring trona.

Preferably, the crutcher slurry contains from 50 to 65% of solids and 50 to 35% of water, of which solids content 55 to 80% is sodium bicarbonate, 10 to 25% is sodium carbonate and 5 to 25% is sodium silicate of $Na_2O$:$SiO_2$ ratio within the range of 1:1.6 to 1:2.6. The ratio of sodium bicarbonate:sodium carbonate is preferably within the range of 3:1 to 6:1, the ratio of sodium carbonate:sodium silicate is preferably within the range of 2:5 to 5:2 and the ratio of sodium bicarbonate:sodium silicate is preferably within the range of 4:1 to 8:1. In the present invented method sodium sesquicarbonate is utilized in place of portions of the bicarbonate and carbonate, normally supplying up to 100% of the sodium carbonate, preferably about 30 to 100% thereof. In the preferred crutcher mixes, while it is not necessary for citric material, such as citric acid, and magnesium sulfate, to be present, because the sodium sesquicarbonate has an anti-gelling and stabilizing effect on mobile, miscible and pumpable crutcher slurries made without such materials, normally it is preferable for the crutcher slurry to contain 0.05 to 1% of a citric material, such as citric acid, water soluble citrate, e.g., sodium citrate, potassium citrate, magnesium citrate, or a mixture thereof, and such citric material is incorporated in the slurry before addition of the sodium sesquicarbonate thereto and preferably, before addition of the sodium silicate or at least before addition of a part of the sodium silicate. For additional anti-gelling effects, when such are desirable, the crutcher slurry may contain from 0.1 to 1.4% of magnesium sulfate, too. Magnesium present in magnesium citrate may be employed in replacement of the stoichiometric equivalent of magnesium sulfate. More preferably, the percentage of citric acid utilized is from 0.1 to 0.5 and that of magnesium sulfate, when present, is from 0.2 to 1.2%. When they are employed together it is preferred that at least 0.4% of the sum thereof be present.

In more preferred methods within the present invention the compositions of the crutcher slurry are from 58 to 65% of solids and 42 to 35% of water, with the solids content being 65 to 77% of sodium bicarbonate, 12 to 18% of sodium carbonate and 11 to 17% of sodium silicate. In such slurries the ratio of sodium bicarbonate:sodium carbonate is within the range of 4:1 to 5:1, the ratio of sodium carbonate:sodium silicate is within the range of 2:3 to 3:2 and the ratio of sodium bicarbonate:sodium silicate is within the range of 4:1 to 6:1. The sodium silicate in such slurries is of $Na_2O$:$SiO_2$ ratio within the range of 1:1.6 to 1:2.4, the citric material, when present, is added as citric acid, the percentage of citric acid is from 0.2 to 0.4% and the percentage of sodium sesquicarbonate added is from 5 to 20% (molecular weight basis of 226). This is from 50 to 100% of the desired sodium carbonate content of the slurry.

The materials described above, except water, are all normally solid and the percentages and ratios given are on an anhydrous basis, except for the sodium sesquicarbonate when its solids content is considered. The various materials may be added to the crutcher as hydrates or they may be dissolved or dispersed in water. Normally, the sodium bicarbonate is an anhydrous powder and the sodium carbonate is soda ash, also in powder form, as is the sodium sesquicarbonate added. The carbonate monohydrate may also be employed. The silicate is usually added to the crutcher slurry as an aqueous solution, normally of 40 to 50% solids content, e.g., 47.5%, and is preferably added near the end of the mixing and after previous addings and dispersings of any citric material and magnesium sulfate (or magnesium citrate) which may be utilized, and after additions of bicarbonate and carbonate, when carbonate is added before the sesquicarbonate. Most preferably the silicate will be of $Na_2O:SiO_2$ ratio in the range of 1:2.0 to 1:2.4, e.g., 1:2.35 or 1:2.4. The various powders are normally quite finely divided, usually being of particle sizes which will pass through a No. 60 screen, U.S. Sieve Series and remain on a No. 325 screen, preferably passing through a No. 160 screen and remaining on a No. 230 screen. As was indicated previously, utilization of finely divided sodium sesquicarbonate is of a special importance and the sizes of all solid particulate materials charged should be small enough so that they do not obstruct spray tower nozzles.

Although it is highly preferred to make the crutcher slurry and the base beads product of this invention (from which a heavy duty built nonionic synthetic organic detergent composition can be produced) of essentially inorganic salts, in such manner that they will be of bead properties that promote absorption through the head surfaces of nonionic detergent sprayed thereon in liquid form, and although often the adjuvants, such as perfumes, colorants, enzymes, bleaches and flow promoting agents, may be sprayed onto the beads with the nonionic detergent or may be post-added, for stable and normally solid adjuvants mixing in with the inorganic salt slurry in the crutcher is often feasible. Thus, it is contemplated that from 0 to as much as 20% of the crutcher slurry may be of suitable adjuvants or diluents (diluents include inorganic salts, such as sodium sulfate and sodium chloride). However, if such adjuvants are present, normally the proportion thereof will be from 0.1 to 10% and often their content will be limited to 5%, and sometimes to 1 or 2%. Normally the organic material content of the crutcher slurry will be limited to about 5% maximum, preferably 3% maximum and most preferably 1 or 1.5% maximum, so as to avoid any problems of tackiness of the base beads after spray drying and to avoid any adverse effects on absorption of synthetic nonionic organic detergent by the beads. Because sodium sesquicarbonate is inorganic and helps to prevent gelation of the slurry without requiring changing of the desired carbonate-bicarbonate-silicate formula of the beads to be made by spray drying the crutcher slurry, it allows the use of no citric material or less citric material than would normally otherwise be desired and also allows avoidance of the use of magnesium sulfate. Thereby, it promotes the production of more desirable, lower organic content beads and final products without using as much anti-gelling agent (other than the sesquicarbonate) and in many cases, without using any other such agents.

The present methods, utilizing sodium sesquicarbonate as an anti-gelling agent (or stabilizing agent for acceptably mobile crutcher slurries) have been surprisingly successful in preventing gelation, thickening, setting and freezing up of crutcher slurries of the present types before they can be emptied from the crutcher and spray dried, using normal crutching, pumping and spray drying equipment. Such effects allow the manufacture of higher solids content slurries than would otherwise be workable, and allow the use of more carbonate in the finished product formula (obtainable from sodium carbonate and from sodium sesquicarbonate). In the past it has been found that when the ratio of sodium carbonate to sodium bicarbonate in such carbonate-bicarbonate-silicate-water slurries exceeded a certain limit, usually in the range of 20 to 25%, e.g., 21% (or stated differently, when the proportion of sodium carbonate to sodium bicarbonate was greater than about 1:4.7), the slurry could tend to set or thicken objectionably during crutching and processing. Such action sometimes placed limits on the slurry composition or required thinning of the mix or changing its temperature, so as to improve workability. Although a proportion of any bicarbonate is converted to carbonate in the spray tower, when it is desired for the spray dried base beads to be of a particular carbonate:bicarbonate ratio, sometimes such ratio would be unattainable because of the need to modify the crutcher conditions. Thus, the present invention results in greater flexibility of crutcher compositions and operations and allows a better choice and control of crutcher solids content and base beads compositions, particularly with respect to the carbonate:bicarbonate ratio thereof.

The order of additions of the various components of the crutcher slurry is not considered to be critical, except that the sesquicarbonate is added to last after the carbonate (if any), bicarbonate and silicate, and preferably the silicate solution is added after the water, carbonate and bicarbonate. Usually the sesquicarbonate is added within ten minutes of the completion of addition of the silicate, preferably within five minutes, more preferably within one minute and most preferably immediately afterward. Previously the silicate, being a "problem" component, had been admixed in over a comparatively long period time, e.g., 5 to 15 minutes, but it had been found that such time may be diminished appreciably, for example, to from 1 to 4 minutes, e.g., 3.5 minutes, if sesquicarbonate is admixed in soon after, e.g., within two minutes of the completion of the silicate addition. Minor variations in orders of additions of the other constituents of the crutcher slurry may be made under certain circumstances, as when objectionable foaming accompanies the following of a specific, otherwise desirable order. However, such problems have not been found to be serious, in practice. In some instances it is possible to premix magnesium sulfate, when it is employed, with citric material and the mixture thereof may be added to the crutcher, usually before all other components except water. In other cases the citric material is added first, followed by magnesium sulfate, if employed, or vice versa. When citric material is being employed it is preferred to add it to the water, followed by sodium carbonate (when employed), sodium bicarbonate, sodium silicate solution and sodium sesquicarbonate. Any of the usual detergent composition adjuvants are preferably added after the sodium sesquicarbonate but in some cases they may be added with or intermediate other components. Orders of addition of slurry materials may be changed providing that irreversible gelation does not occur, and sometimes, to speed processing, such changes may be desirable. For example, one may add some of the water to the crutcher initially, followed by portions of the inorganic salts, either carbonate or bicarbonate or both, followed by more water and more salt(s), and such may be done either before or after citric material addition, if such citric material is being employed. The water utilized may be city water of ordinary hardness, e.g., 50 to 150 p.p.m., as $CaCO_3$, or may be deionized or distilled water. The latter purified waters are preferred, if available, because some metallic impurities in the water can sometimes have a triggering action on gel formation, but in normal operations tap water or city water is acceptable.

The temperature of the aqueous medium in the crutcher will usually be elevated, often being in the 40° to 70° C. range, preferably being from 40° to 60° C. or 50° to 60° C. Heating the crutcher medium promotes solution of the water soluble salts of the slurry and thereby increases slurry mobility. However, temperatures higher than 70° C. will usually be avoided because of the possibility of decomposition of one or more crutcher mix components, e.g., sodium bicarbonate, and sometimes excess heating can cause setting of a gel. Heating of the crutcher mix, which may be effected by utilizing hot aqueous medium charged and by heating the crutcher and/or crutcher contents with a heating jacket or heating coils, also helps to increase drying tower throughput because less energy has to be transferred to the spray droplets of crutcher mix in the tower. Using higher solids mixes, which is facilitated by the present method, also increases such production rates.

Crutcher mixing times to obtain good slurries can vary widely, from as little as ten minutes for small crutchers and for slurries of higher moisture contents, to as much as four hours, in some cases. The mixing times needed to bring all the crutcher mix components together in one satisfactorily "homogeneous" medium may be as little as five minutes but in some cases can be up to an hour, although 30 minutes is a preferable upper limit. Counting any such initial admixing times, normal crutching periods will be from 20 minutes to two hours, e.g., 30 minutes to one hour, but the crutcher mix will be such as to be mobile, not gelled or set, for at least one hour, preferably for two hours and more preferably for four hours or more often after completion of the making of the mix, e.g., 10 to 30 hours, to allow for any processing delays.

The crutched slurry, with the various salts, dissolved or in particulate form, uniformly distributed therein, is subsequently transferred to a spray drying tower, which is located near the crutcher. The slurry is normally dropped from the bottom of the crutcher to a positive displacement pump, which forces it at high pressure, e.g., 7 to 50 kg./sq. cm., through spray nozzles at the top of the conventional spray tower (countercurrent or concurrent), wherein the droplets of the slurry fall through a heated drying gas, which is usually composed of the combustion products of fuel oil or natural gas, in which drying gas the droplets are dried to desired absorptive bead form. During the drying operation at least part of the sesquicarbonate is converted to carbon dioxide, carbonate and water and at least part of the bicarbonate is converted to carbonate and water, while releasing carbon dioxide. These changes appear to improve the physical characteristics of the beads made so that they become more absorptive of liquids, such as nonionic detergent in liquid state, which may be post-sprayed onto them subsequently.

After drying, the product is screened to desired size, e.g., 10 to 100 mesh, U.S. Standard Sieve Series, and is ready for application of nonionic detergent spray thereto, with the beads being either in warm or cooled (to room temperature) condition. The nonionic detergent employed will usually be at an elevated temperature to assure that it will be liquid; yet, upon cooling to room temperature, desirably it will be a solid, often resembling a waxy solid. The nonionic detergent, applied to the tumbling beads in known manner, as a spray or as droplets, is preferably a condensation product of ethylene oxide and higher fatty alcohol, with the higher fatty alcohol being of 10 to 20 carbon atoms, preferably of 12 to 16 carbon atoms, and more preferably averaging 12 to 13 carbon atoms, and with the nonionic detergent containing from 3 to 20 ethylene oxide groups per mole, preferably from 5 to 12, more preferably 6 to 8. The proportion of nonionic detergent in the final product will usually be from 10 to 25%, such as from 20 to 25%, but more or less can be used, depending on the final detergent product characteristics sought and the flowability of the product obtainable.

A preferred finished formulation made from base beads produced in accordance with this invention contains from 15 to 25%, preferably 20 to 25% of the nonionic detergent, e.g., Neodol® 23-6.5, made by Shell Chemical Company, 30 to 40% of sodium bicarbonate, 15 to 20% of sodium carbonate, 5 to 15% of sodium silicate of $Na_2O:SiO_2$ ratio of about 1:2.4, 1 to 3% of fluorescent brightener, 0.5 to 2% of proteolytic enzyme, sufficient bluing to color the product and whiten the wash, as desired, e.g., 0 to 0.5%, 0.5 to 15% of moisture, e.g., 10%, and 0.4 to 1.8% of citric material, as sodium citrate (when present). Of course, various non-essential adjuvants may be omitted, and if desired, others too, may be employed. Instead of the particular nonionic detergent mentioned other such detergents equivalent in function may be substituted. Optionally, sodium sulfate may be present as a diluent but the amount thereof will normally be restricted to 20%, preferably to 10% and most preferably will be less than 5%, if any is present. The base beads made, devoid of nonionic detergent and adjuvants, will preferably comprise from 35 or 40 to 60% of sodium bicarbonate, 15, 20 or 25 to 45% of sodium carbonate, 10 to 20% of sodium silicate, 0.2 to 1% of sodium citrate (if present), 0 to 10% of adjuvant(s) and/or diluent(s) and 1 to 15% of moisture. In such spray dried beads the proportion of sodium bicarbonate will normally be within the range of 1.2 to 4 times that of sodium carbonate, e.g., 1.5 to 3.

The highly beneficial result of incorporating sodium sesquicarbonate in the present crutcher slurries in accordance with this invention is four-fold: (1) gelation and setting of the crutcher mix in the vessel before complete discharge thereof is prevented; (2) higher solids content crutcher slurries may be made; (3) higher carbonate content crutcher slurries may be made, (4) and such improvements may be obtained without the need to utilize anti-gelling adjuvants which would otherwise not be intentionally employed in the final base bead and detergent products. Also, when citric material, such as citric acid, is employed for its anti-gelling properties, lesser amounts thereof may be used and, in conjunction with the use of the sodium sesquicarbonate, improved anti-gelling and stabilizing effects are obtainable. Tests of the properties of the final base beads and detergent products indicate that no adverse effects result because of the utilization of the present invention and the incorporation in the products of the sodium sesquicarbonate. When citric acid or other citric material is employed it may have desirable effects on the stabilities of perfumes and colors and may help to prevent the development of malodors from deteriorations of other organic materials that may be present, such as proteolytic enzymes and proteinaceous substances.

While it is clear that when crutcher slurries are made containing more than equimolar proportions of sodium bicarbonate with respect to sodium carbonate, the addition of sodium sesquicarbonate at the end of the mixing method will reduce the ratio of carbonate to bicarbonate in the mix at earlier stages, thereby helping to prevent gelation (which appears to be worse when greater proportions of carbonate are present), this alone is not the explanation for the desirable effects obtained from the present invention. In comparative experiments, when instead of the adding of the sodium sesquicarbonate at the end of the mixing process there are added stoichiometrically equivalent weights of soda ash and sodium bicarbonate, the anti-gelling and stabilization effects of the sesquicarbonate addition are not obtained. Thus, such control mixes tended to gel earlier than those made in accordance with the present invention.

For a particular desired base bead composition, by varying the process of the present invention one may choose the highest solids content crutcher slurry feasible, normally employing a safety factor to avoid any accidental gelation in the crutcher, and may select the most desirable proportions of sodium carbonate and sodium bicarbonate to be "replaced" by sodium sesquicarbonate, considering economic and physical factors. In all such methods within this invention one may be assured that normal spray drying operations can be conducted without interruption and without the need for cleaning out of equipment in which a slurry being processed has thickened, gelled or set to an objectionable extent.

The following examples illustrate but do not limit the invention. Unless otherwise indicated all temperatures are in °C. and all parts are by weight in the examples and throughout the specification.

EXAMPLE 1

| Component | Parts by Weight |
|---|---|
| Deionized water | 519 |
| Soda ash | 65 |
| Sodium bicarbonate | 585 |
| Sodium silicate solution (47.5% aqueous solution; $Na_2O:SiO_2$ = 1:2.4) | 272 |
| Sodium sesquicarbonate | 160 |

A crutcher mix of the above formula is made by addition of the listed components in the order given to a heated crutcher, in which the temperature is maintained in the range of 40° to 60° C., being about 46° C. when the batch is dropped from the crutcher. The soda ash, sodium bicarbonate and sodium sesquicarbonate are all in powder form, with particle sizes in the range of No. 100 to 325, U.S. Sieve Series, with over 95% by weight of the sodium sesquicarbonate being in particles in the No. 160 to 230 range. After delivery of the deionized water to the crutcher, addition of the soda ash is completed within one minute, addition of the sodium bicarbonate is completed within two minutes after about a one minute hiatus, addition of the silicate solution is completed in an additional 3.5 minutes, and begins immediately after all the bicarbonate is present, and the addition of sodium sesquicarbonate is completed over two minutes, after a one minute interval.

Following an additional ten minutes of mixing after completion of the making of the crutcher slurry it is dried in a countercurrent spray dryer into which the slurry is sprayed through spray nozzles under a pressure of about 40 kg./sq. cm. The drying gas in the spray dryer is at a temperature in the range of 250° to 350° C. Such drying process yields free flowing base beads of particle sizes in the range of No. 8-160 and of a moisture content of about 10%. The bulk density of such product is about 0.6 g./ml. and its flow rate is about 88% of that of an equal volume of dry sand of comparable particle size. See U.S. Pat. No. 4,269,722 issued May 26, 1981 corresponding to U.S. patent application Ser. No. 964,037, filed Dec. 21, 1978, for a description of the method for determining flowability. The desirable properties of the beads made are considered to be attributable to a significant extent to the conversion of a part of the bicarbonate content to carbonate (usually a 10 to 50% reaction) and the at least partial changing of the sesquicarbonate to carbon dioxide, carbonate and water in the spray dryer.

The base beads made, at a temperature of about 30° C., are sprayed, while being tumbled, with a nonionic detergent, Neodol® 23-6.5, manufactured by Shell Chemical Company, which is in liquid state and at a temperature of 45° C. The built detergent composition made, unperfumed and without enzymes, fluorescent brighteners and bluing agents, which are often present in various commercial products, contains about 22% of the nonionic detergent, and when cooled to room temperature, is satisfactorily freely flowing, with a flowability over 70%. It is also an excellent heavy duty laundry detergent. The base beads are of a characteristic porous structure capable of absorbing nonionic detergent into the interiors thereof when it is in liquid state, and the final detergent product contains a substantial proportion (more than half) of the nonionic detergent in the interiors of the beads thereof.

Shortly after the completion of the making of the crutcher slurry the vicosity thereof is measured, using a Brookfield LVF viscometer at a rotation speed of 60 revolutions per minutes, and it is found to be 470 centipoises. A portion of the crutcher mix is retained and is maintained for five days at a temperature of 38° C., after which the viscosity is measured, using the same instrument and conditions, and is found to be 390 centipoises, showing the viscosity stabilizing effect of the present method of making a high solids (58.7%) aqueous crutcher slurry of sodium carbonate, sodium bicarbonate, sodium silicate and sodium sesquicarbonate, without the use of any other viscosity reducing or regulating additives.

In a variation of this experiment the identical procedure is followed except that the amount of deionized water utilized is 515 parts and before addition of the soda ash to the water four parts of citric acid are added thereto. The percentage of solids in the final crutcher mix is 58.9, the initial viscosity is 470 centipoises and after five days at 38° C. it is 310 centipoises. When, in addition to the employment of the citric acid, 16 parts of deionized water are replaced by 16 parts of magnesium sulfate (Epsom salts) which are mixed in with the aqueous medium immediately after the citric acid, the solids content is increased to 59.9% and the slurry is of satisfactory low viscosity initially and after comparable storage at elevated temperature. However, when, instead of adding the 160 parts of sodium sesquicarbonate at the end portion of the crutcher slurry manufacturing process, the equivalent proportions of sodium carbonate, sodium bicarbonate and water are employed, so that the amount of soda ash is 140 parts, the amount of sodium bicarbonate is 645 parts and the amount of water is 544 parts (not counting that in the sodium silicate solution) the slurry solidifies in the crutcher during manufacture, when no gelation preventing additives are used. Even when such additives are employed the present processes allow faster addition of the silicate solution to the crutcher mix without gelation occurring during such addition, which advantage is even more significant without the addition of gelation preventing materials, so that faster batch times and resulting increases in operating efficiencies and economies are obtainable by means of the present method.

When variations of the described invented methods are run, utilizing normal adjuvants for commercial built detergent products, 1.5% of fluorescent brightener and 0.15% of blue pigment in the crutcher slurry and 1.4% of proteolytic enzyme and 0.1% of perfume in the final product (applied by admixing and spraying, respectively), essentially the same results are obtained.

EXAMPLE 2

| Component | Parts by Weight |
|---|---|
| Deionized water | 492 |
| Citric acid | 4 |
| Sodium bicarbonate | 534 |
| Sodium silicate solution | 272 |
| Sodium sesquicarbonate | 299 |

The components of the crutcher slurry and the method are those described in Example 1, except that no soda ash is employed. The crutcher slurry includes 60.4% of solids and the final batch temperature is 47° C. The initial viscosity of the slurry is 440 centipoises and after five days of storage at 38° C. it is 650 centipoises. In a similar experiment in which the citric acid is omitted, being replaced by four parts of deionized water, with all other components being the same, a 60.2% solids slurry is made and has a 46° C. final batch temperature. The viscosity of this slurry is 430 centipoises initially and 1,020 centipoises after the described five days holding at 38° C.

From the above experiments it is seen that although the citric acid appears to have little effect on initial viscosities of these crutcher slurries, after lengthy storage the combination of sodium sesquicarbonate and citric acid tends to stabilize the viscosity better and prevents dramatic increases thereof. However, it must be stressed that five days storage is more than would be encountered in normal commercial operations and even after five days the described 1,020 centipoises material is pumpable and sprayable.

Similar results are obtained when the solids contents of the crutcher slurries are further increased, up to a maximum of about 70% (usually to no more than 65%), with care being taken to utilize anti-gelling materials, desirable proportions of slurry components, favorable temperature conditions and good mixing, and to follow the described procedure closely. Comparable results are also obtainable when magnesium sulfate is included with the citric acid as an anti-gelling material, the temperature is raised to over 50° C., e.g., 52° C., and even when the silicate content is increased substantially, e.g., by 25% thereof and the bicarbonate content is diminished accordingly.

When the proportions of the various components of the formulas processed by the method of this invention are varied ±10%, ±20% and ±30%, but are maintained within the ranges of proportions previously specified, and when the invented method steps are followed, correspondingly successful non-gelling and stable crutcher slurries are obtainable.

EXAMPLE 3

(Comparative Example)

| Component | Parts by Weight |
|---|---|
| Water | 540 |
| Citric acid | 4 |
| Soda ash | 140 |
| Sodium bicarbonate | 645 |
| Sodium silicate solution | 272 |

The materials employed are the same as those of the previous examples, as are the procedural steps, with the exception that there is no addition of sodium sesquicarbonate and the period of the addition of the silicate is longer, about eight minutes, to prevent premature gelation. Despite constant vigorous stirring (a turbine mixer operating at 2,100 r.p.m.), the slurry solidifies within an hour.

In a variation of this experiment, when the "initial" amounts of soda ash and sodium bicarbonate are changed to 65 and 585 parts, respectively, and after addition of the sodium silicate solution the remaining 75 parts of soda ash and 60 parts of sodium bicarbonate are added back to the slurry (in place of sodium sesquicarbonate which would be added in accordance with this invention), the slurry obtained is unstable, and solidifies within two hours. On the contrary, when the procedure of Example 1 is followed the mix is of low viscosity and is stable, even days after manufacture.

The invention has been described with respect to various illustrations and embodiments thereof but is not be limited to these because it is evident that one of skill in the art, with the present description before him, will be able to utilize substitutes and equivalents without departing from the invention.

What is claimed is:

1. A method of retarding or preventing the gelation of a crutcher slurry containing from about 40 to 70% of solids and 60 to 30% of water, of which solids content, on a 100% solids basis, about 55 to 85% is sodium bicarbonate, about 5 to 25% is sodium carbonate and about 5 to 25% is sodium silicate of $Na_2O:SiO_2$ ratio within the range of 1:1.4 to 1:3, with the ratio of sodium bicarbonate:sodium carbonate being within the range of about 2:1 to 8:1, the ratio of sodium carbonate:sodium silicate being within the range of about 1.3 to 3:1, and the ratio of sodium bicarbonate:sodium silicate being within the range of about 2:1 to 10:1, which comprises preparing a crutcher slurry of the described composition by admixing with other components of such slurry, an amount of sodium sesquicarbonate which will supply from about 30 to 100% of the sodium carbonate.

2. A method according to claim 1 wherein the crutcher slurry contains from 50 to 65% of solids and 50 to 35% of water, of which solids content 55 to 80% is sodium bicarbonate, 10 to 25% is sodium carbonate and 5 to 25% is sodium silicate of $Na_2O:SiO_2$ ratio within the range of 1:1.6 to 1:2.6, the ratio of sodium bicarbonate:sodium carbonate is within the range of 3:1 to 6:1, the ratio of sodium carbonate:sodium silicate is within the range of 2:5 to 5:2 and the ratio of sodium bicarbonate:sodium silicate is within the range of 4:1 to 8:1.

3. A method according to claim 1 wherein the crutcher slurry contains from 0.05 to 1% of a gelation inhibiting citric material selected from the group consisting of citric acid, water soluble citrate and mixtures thereof which is incorporated in the slurry before addition of the sodium sesquicarbonate thereto.

4. A method according to claim 2 wherein the crutcher slurry contains 0.1 to 0.5% of a gelation inhibiting citric material selected from the group consisting of citric acid, water soluble citrate and mixtures thereof, which is incorporated in the slurry before addition thereto of the sodium silicate and sodium sesquicarbonate.

5. A method according to claim 4 wherein the order of addition to the crutcher of the components to form the crutcher slurry is water, citric material, sodium carbonate, sodium bicarbonate, sodium silicate, as an aqueous solution, and sodium sesquicarbonate and wherein the proportion of sodium carbonate supplied by the sodium sesquicarbonate is from 50 to 100% thereof.

6. A method according to claim 5 wherein the crutcher slurry is at a temperature in the range of 35° to 70° C. and is at atmospheric pressure.

7. A method according to claim 6 wherein the crutcher slurry contains from 58 to 65% of solids and 42 to 35% of water, of which solids content 65 to 77% is sodium bicarbonate, 12 to 18% is sodium carbonate, 11 to 17% is sodium silicate of $Na_2O:SiO_2$ ratio within the range of 1:1.6 to 1:2.4, the ratio of sodium bicarbonate:-sodium carbonate is within the range of 4:1 to 5:1, the ratio of sodium carbonate:sodium silicate is within the range of 2:3 to 3:2 and the ratio of sodium bicarbonate:-sodium silicate is within the range of 4:1 to 6:1, the citric material is added as citric acid, the percentage of citric acid is 0.2 to 0.4% and the percentage of sodium sesquicarbonate added is from 5 to 20%.

8. A method according to claim 1 wherein the mixing is at an elevated temperature, in the range of 40° to 70° C. and is continued for at least one hour after completion of the making of the crutcher slurry.

9. A method according to claim 7 wherein the crutcher slurry temperature is from 40° to 60° C., mixing is effected for at least two hours after completion of the making of the crutcher slurry, and at least a part of the crutcher slurry, after mixing for at least two hours, is pumped out of the crutcher to a spray drying tower and is spray dried therein to dry particulate form.

10. A method according to claim 3 wherein the gelation preventing citric material is citric acid.

11. A method according to claim 3 wherein from 0.1 to 10% of the crutcher slurry is of adjuvant(s) and/or diluent(s).

12. A method according to claim 3 wherein the crutcher slurry contains from 0.1 to 1.4% of magnesium sulfate.

13. A method according to claim 10 wherein the percentage of citric acid is from 0.2 to 0.8, the crutcher slurry contains from 0.2 to 1.2% of magnesium sulfate and the citric acid and magnesium sulfate are incorporated in the slurry before addition thereto of at least some of the sodium silicate.

14. A method of making a particulate base material in bead form, suitable for absorbing nonionic detergent to make a built heavy duty synthetic organic detergent composition, which comprises making a miscible and pumpable slurry in a crutcher by the method of claim 1, pumping the slurry out of the crutcher in ungelled and readily pumpable state and spray drying the slurry to particulate bead form, during which spray drying a portion of the sodium sesquicarbonate is converted to sodium carbonate and a portion of the sodium bicarbonate is converted to sodium carbonate.

15. A method according to claim 9 wherein the sodium sesquicarbonate added to the crutcher slurry is of particle sizes in the range of Nos. 160 to 230, U.S. Sieve Series.

16. A method according to claim 14 wherein the sodium sesquicarbonate added to the crutcher slurry is of particle sizes in the range of Nos. 60 to 325, U.S. Sieve Series.

* * * * *

UNITED STATES PATENT AND TRADEMARK OFFICE

CERTIFICATE OF CORRECTION

PATENT NO. : 4,311,606

DATED : January 19, 1982

INVENTOR(S) : James A. Kaeser

It is certified that error appears in the above—identified patent and that said Letters Patent is hereby corrected as shown below:

Column 6, line 31, "had" should be --has--.

Column 7, line 33, after "more" delete --often--.

Signed and Sealed this

*Twenty-fourth* Day of *August 1982*

[SEAL]

*Attest:*

GERALD J. MOSSINGHOFF

*Attesting Officer*

*Commissioner of Patents and Trademarks*